US007614367B1

(12) United States Patent
Frick

(10) Patent No.: US 7,614,367 B1
(45) Date of Patent: Nov. 10, 2009

(54) METHOD AND APPARATUS FOR HEATING, CONCENTRATING AND EVAPORATING FLUID

(75) Inventor: Franklin Alan Frick, Houston, TX (US)

(73) Assignee: F. Alan Frick, Houston, TX (US)

( * ) Notice: Subject to any disclaimer, the term of this patent is extended or adjusted under 35 U.S.C. 154(b) by 249 days.

(21) Appl. No.: 11/748,475

(22) Filed: May 14, 2007

Related U.S. Application Data

(60) Provisional application No. 60/800,495, filed on May 15, 2006.

(51) Int. Cl.
*F22B 3/06* (2006.01)

(52) U.S. Cl. ..... 122/26; 122/406.1; 122/411; 237/12.3 B; 126/247

(58) Field of Classification Search ..... 122/26, 122/406.1, 406.2, 406.3, 411; 237/12.3 B, 237/12.3 R; 166/250.1, 266, 267; 210/708, 210/737, 738, 748; 175/40, 66, 206, 207; 126/247
See application file for complete search history.

(56) References Cited

U.S. PATENT DOCUMENTS

| | | | | |
|---|---|---|---|---|
| 2,156,333 | A | 5/1939 | Cross | |
| 3,198,191 | A | 8/1965 | Wyszomirski | |
| 3,533,480 | A | 10/1970 | Chenevert | |
| 3,791,349 | A | 2/1974 | Schaefer | |
| 4,196,854 | A | 4/1980 | Prucyk | |
| 4,264,826 | A * | 4/1981 | Ullmann | 290/2 |
| 4,273,075 | A | 6/1981 | Freihage | |
| 4,370,885 | A | 2/1983 | Alekhin | |
| 4,438,729 | A * | 3/1984 | Loesch et al. | 122/26 |
| 4,458,633 | A * | 7/1984 | Loesch et al. | 122/26 |
| 4,483,277 | A | 11/1984 | Perkins | |
| 4,494,524 | A | 1/1985 | Wagner | |
| 4,576,122 | A * | 3/1986 | Marcato | 122/26 |
| 4,651,681 | A | 3/1987 | Perkins | |
| 4,779,575 | A | 10/1988 | Perkins | |
| 4,781,151 | A | 11/1988 | Wolpert et al. | |
| 4,843,824 | A * | 7/1989 | Mushines | 60/667 |
| 5,188,090 | A | 2/1993 | Griggs | |
| 5,239,948 | A | 8/1993 | Sajewski | |
| 5,279,262 | A * | 1/1994 | Muehleck | 122/26 |
| 5,341,768 | A | 8/1994 | Pope | |
| 5,385,298 | A * | 1/1995 | Griggs | 237/1 R |
| 5,472,620 | A | 12/1995 | Huang | |
| 5,656,136 | A | 8/1997 | Gayaut et al. | |
| 5,931,153 | A | 8/1999 | Giebeler | |

(Continued)

OTHER PUBLICATIONS

Plaintiff's Third Amended Petition, and Application for Temporary Restraining Order, Temporary Injunction, and Permanent Injunction, Jun. 30, 2008, 61 pgs.

(Continued)

*Primary Examiner*—Gregory A Wilson
(74) *Attorney, Agent, or Firm*—Locke Lord Bissell & Liddell LLP

(57) ABSTRACT

A system and method are provided for heating, concentrating and/or evaporating a fluid by heating the fluid in a heating subsystem comprising a rotary heating device, such as a water brake dynamometer, and then evaporating all or a portion of the fluid in an evaporation subsystem and/or concentrating the fluid in a concentration subsystem.

15 Claims, 9 Drawing Sheets

U.S. PATENT DOCUMENTS

| | | | | |
|---|---|---|---|---|
| 5,937,848 | A | 8/1999 | Madden | |
| 5,957,122 | A * | 9/1999 | Griggs | 126/247 |
| 5,988,280 | A | 11/1999 | Crawford et al. | |
| 6,016,798 | A | 1/2000 | Selivanov | |
| 6,164,274 | A | 12/2000 | Giebeler et al. | |
| 6,250,561 | B1 | 6/2001 | Fujiwara et al. | |
| 6,371,381 | B1 | 4/2002 | Niwa | |
| 6,386,751 | B1 | 5/2002 | Wootan et al. | |
| 6,581,859 | B2 | 6/2003 | Adams et al. | |
| 6,595,759 | B2 | 7/2003 | Crosta et al. | |
| 6,596,178 | B1 * | 7/2003 | Archibald et al. | 210/774 |
| 6,627,784 | B2 | 9/2003 | Hudson et al. | |
| 6,666,906 | B2 | 12/2003 | Hallman | |
| 6,896,718 | B2 | 5/2005 | Hallman | |
| 6,910,448 | B2 | 6/2005 | Thoma | |
| 6,974,305 | B2 | 12/2005 | Garrett | |
| 7,032,544 | B2 | 4/2006 | Kuo et al. | |
| 7,089,886 | B2 | 8/2006 | Thoma | |
| 7,201,225 | B2 * | 4/2007 | Smith et al. | 166/250.01 |
| 7,318,553 | B2 | 1/2008 | Thoma | |
| 7,424,916 | B2 | 9/2008 | Foster et al. | |
| 2005/0224223 | A1 | 10/2005 | Hayes | |
| 2006/0185621 | A1 * | 8/2006 | Foster et al. | 122/26 |

OTHER PUBLICATIONS

F. Alan Frick's Second Amended Answer and Counter Claims Against Total Separation Solutions, LLC, Apr. 11, 2008, 16 pgs.
Pleadings Index from Jan. 26, 2007 through Mar. 20, 2009, 47 pgs.
Affidavit of F. Alan Frick, Mar. 2, 2007, 20 pgs.
Clearwater Potassium Formate Production System (1995), Oct. 31, 2007, 1 pg.
Annotated Fig. 1 from U.S. Appl. No. 60/800,495, Apr. 23, 2006, 1 pg.
List of Deposition Transcripts, Apr. 9, 2009, 38 pgs.
Deposition Transcript of Albert B. Deaver, Jr., Jul. 9, 2008, 38 pgs.
Protest Pursuant to 37 CFR 1.291, Jun. 2, 2008, 42 pgs.
Leader Energy Services Ltd., Flameless Hot Oiler / Pumping Unit, 2004, 4 pgs., Canada.
PD&E Resource Services Corp., Proheat Flameless Steamers, 2004, 3 pgs., Canada.
PD&E Resource Services Corp., Proheat Flameless Boilers, 2004, 3 pgs., Canada.

* cited by examiner

METHOD AND APPARATUS FOR HEATING, CONCENTRATING AND EVAPORATING FLUID

CROSS REFERENCE TO RELATED APPLICATIONS

This application is based on and claims priority to and benefit of U.S. Provisional Application Ser. No. 60/800,495 filed on May 15, 2006, the full disclosure of which is incorporated herein by reference for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates generally to systems and their use for flamelessly heating a fluid, concentrating a fluid and/or evaporating a fluid.

2. Description of the Related Art

Oilfield operations oftentimes require sources of heat, such as, for example, to produce steam or heat fracturing fluids. In the past, the oil field has looked to both flame and flameless heat sources.

For example, U.S. Pat. No. 6,776,227 describes an "[a] pparatus and method for heating and preventing freeze-off of wellhead equipment utilize radiant heat from a flameless heater to heat fluid in a heat exchanger, such as a tank or finned radiator. A pump is used to circulate the heated fluid through a conduit loop deployed in thermal contact with the equipment to be heated, such that the heat from the fluid is transferred to the equipment, maintaining it at sufficient temperature to prevent freeze-off. The apparatus and method may also be used for other purposes, such as for circulating heated fluid through a liquid-cooled engine to facilitate cold weather starting."

U.S. Pat. No. 4,458,633 describes "[a] flameless nitrogen vaporizing unit [that] includes a first internal combustion engine driving a nitrogen pump through a transmission. A second internal combustion engine drives three coolant circulation pumps against a variable back pressure so that a variable load may be imposed upon the second engine. Liquid nitrogen is pumped from the nitrogen pump driven by the first engine into a first heat exchanger where heat is transferred from exhaust gases from the first and second internal combustion engines to the liquid nitrogen to cause the nitrogen to be transformed into a gaseous state. The gaseous nitrogen then flows into a second heat exchanger where it is superheated by an engine coolant fluid to heat the gaseous nitrogen to essentially an ambient temperature. The superheated nitrogen is then injected into the well. The engine coolant fluid is circulated in a coolant circulation system by the coolant circulation pumps. Methods of vaporizing nitrogen are also disclosed."

In addition, it is known that water produced in conjunction with hydrocarbons from subterranean wells or coal from subterranean mines can undesirably dilute fluids, such as well completion fluids, and can pose a substantial disposal burden.

For example, U.S. Pat. No. 7,201,225 describes "[a] cavitation device . . . to heat, concentrate and recycle or otherwise reuse dilute and other oil well fluids, brines and muds, and solution mining fluids, all of which commonly contain ingredients worthy of conservation. The cavitation device is powered by a Diesel engine whose exhaust may be used to heat the incoming fluid, and the product of the cavitation device is directed to a flash tank."

Also, U.S. Pat. No. 5,279,262 describes "[a] water brake which uses mechanical power to kinetically heat water to vapor or steam, and use thereof as a steam generator or cooling water conserving dynamometer or motion retarder. In the simplest embodiment, radial impeller vanes (5b) throw water against stator vanes (6e), whence the water rebounds to the impeller (5). The peripheral rebounding movement continues back and forth. Power dissipates as heat in the water causing the water to increase in temperature and to vaporize. The vapor, being lower in density and viscosity than is the water, flows to and out a central outlet (9) while the denser water is centrifugally separated from the vapor and retained in the peripheral rebounding motion. Water leaving as vapor is continually replaced through a cooling water inlet (8), allowing continuous operation over wide ranges of speed, torque, power, and steam generation rates, both at steady state and at controlled rates of change.

The present disclosure is directed to a system and method for flamelessly heating, concentrating or evaporating a fluid by converting rotary kinetic energy into heat.

BRIEF SUMMARY OF THE INVENTION

One aspect of the inventions disclosed herein is a method of and apparatus for evaporating a fluid, which may comprise providing a prime mover that is adapted to generate rotational kinetic energy and thermal energy and coupling a dynamometer to the prime mover so that rotational kinetic energy is transferred to the dynamometer. Circulating a first fluid through the dynamometer to impart thermal energy to the fluid. Circulating the first fluid through at least one heat exchanger adapted to transfer thermal energy of the prime mover to the first fluid. Circulating the first fluid through at least a second heat exchanger and passing the fluid to be evaporated through the at least second heat exchanger to transfer thermal energy from the first fluid to the second fluid thereby heating the second fluid. Flashing the second fluid into its vapor and liquid phases. Providing a holding tank adapted to contain the liquid and vapor phases of the second fluid. Providing a fluid-to-air condenser in fluid communication with the tank for condensing at least a portion of the second fluid vapor by passing air across the condenser to transfer thermal energy from the vapor to the air. And, providing an evaporation chamber in fluid communication with the tank for evaporating a portion of the second fluid liquid with the heated air.

Yet another aspect of the inventions disclosed herein is a method of and apparatus for concentrating a fluid, which may comprise providing a prime mover that is adapted to generate rotational kinetic energy and thermal energy. Coupling a dynamometer to the prime mover so that rotational kinetic energy is transferred to the dynamometer. Circulating a first fluid through the dynamometer to impart thermal energy to the first fluid. Circulating the first fluid through at least one heat exchanger adapted to transfer thermal energy of the prime mover to the first fluid. Circulating the first fluid through at least a second heat exchanger. Passing the fluid to be evaporated through the at least second heat exchanger to transfer thermal energy from the first fluid to the second fluid thereby heating the second fluid. Flashing the second fluid into its vapor and liquid phases. Providing a holding tank adapted to contain the liquid and vapor phases of the second fluid. Providing a condenser in fluid communication with the tank for condensing a portion of the second fluid. Condensing the second fluid vapor to its liquid phase. And, extracting the condensed vapor to thereby concentrate the second fluid.

Figure 1:
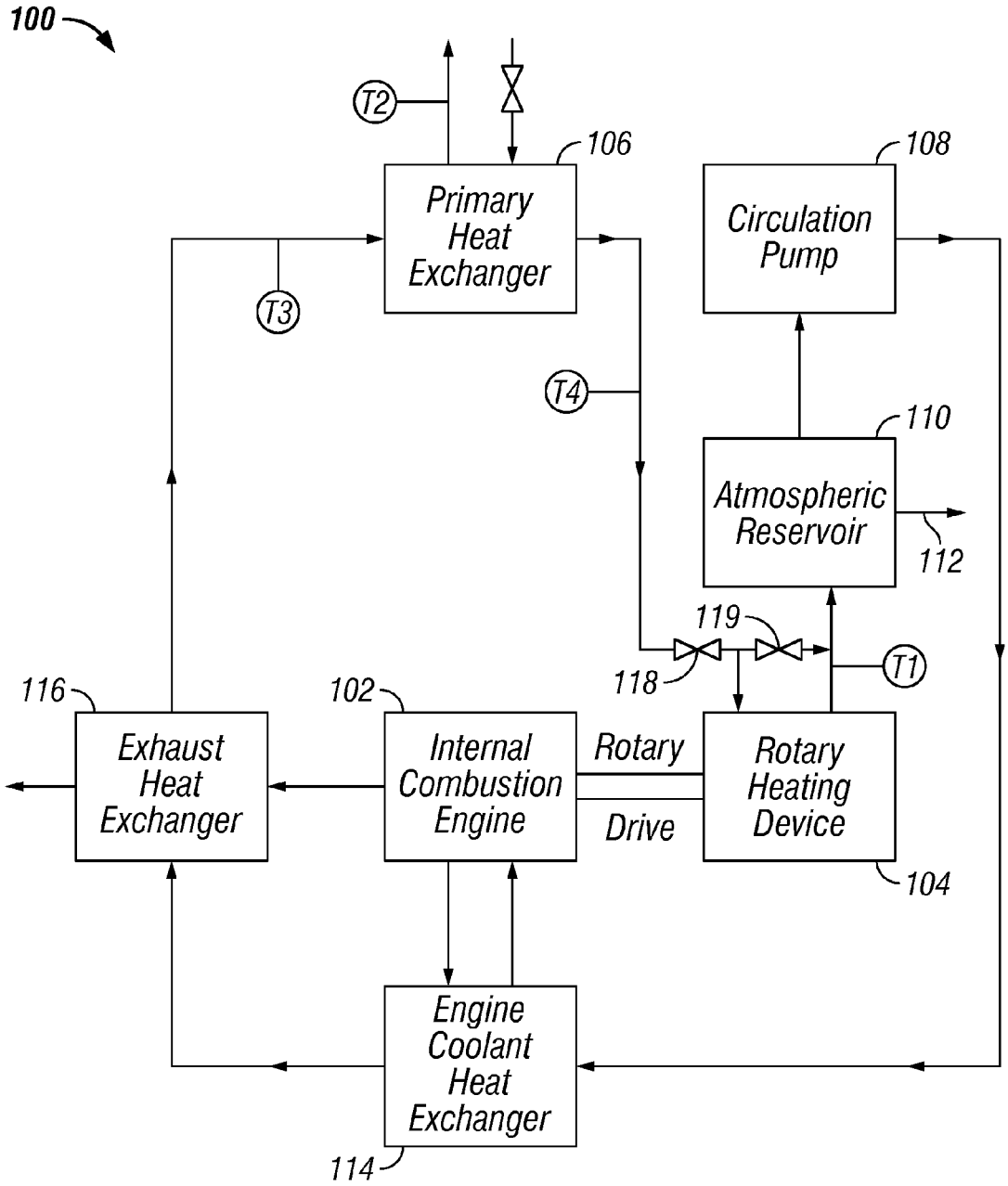
FIG. 1 illustrates one of many embodiments of a closed-loop fluid heater utilizing one or more aspects of the present invention.

While the inventions disclosed herein are susceptible to various modifications and alternative forms, only a few specific embodiments have been shown by way of example in the drawings and are described in detail below. The Figures and detailed descriptions of these specific embodiments are not intended to limit the breadth or scope of the inventive concepts or the appended claims in any manner. Rather, the Figures and detailed written descriptions are provided to illustrate the inventive concepts to a person of ordinary skill in the art and to enable such person to make and use the inventive concepts.

DETAILED DESCRIPTION

One or more illustrative embodiments incorporating the invention disclosed herein are presented below. Not all features of an actual implementation are described or shown in this application for the sake of clarity. It is understood that in the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill in the art having benefit of this disclosure.

In general terms, I have created a system for flamelessly heating fluid and for further use in heating, concentrating and/or evaporating another fluid. In one embodiment, the system has a first fluid-to-fluid (such as liquid-to-liquid) heat exchanger that divides the system into a primary closed-loop fluid section and a secondary closed- or open-loop fluid section. The primary fluid section may comprise rotary kinetic energy generator, such as, but not limited to, an internal combustion engine. The rotary kinetic energy is used to energize a rotary heating device, such as, but not limited to, a water brake dynamometer. A primary or working fluid, such as, but not limited to, water or a water-based mixture, is circulated through the rotary heating device to thereby heat the fluid. In addition, all or a portion of the thermal energy from the rotary kinetic energy generator, such as from the water jacket and/or exhaust gasses, may be transferred to the fluid as well by one or more heat exchangers. A secondary, or worked, fluid may be passed through the first heat exchanger to transfer energy from the working fluid to the worked fluid.

In addition to flamelessly heating the worked fluid, I have created additional sub-systems that allow a worked fluid to be concentrated or evaporated. An evaporation subsystem may comprise a flash tank in which the heated worked fluid is separated into vapor (e.g., steam) and liquid portions. The steam portion is passed through an air-to-fluid heat exchanger to transfer heat from the vapor to air, e.g., ambient air. The heated air is used to evaporate some or all of the liquid portion of the worked fluid.

A fluid concentrator subsystem may comprise a flash tank in which the heated worked fluid is separated into vapor (e.g., steam) and liquid portions. The vapor portion is passed through a heat exchanger to condense the vapor back to liquid. The condensed liquid is removed from the subsystem thereby concentrating the worked fluid.

An alternate fluid concentrator subsystem is especially suited for concentration of fluids, such as completion fluids, used in offshore hydrocarbon recovery efforts. In such embodiment, the primary working fluid is preferably a fluid heated by conventional rig equipment, such as one or more internal combustion engines. For example, the working fluid may comprise the liquid coolant from one or more diesel engines (e.g., water jacket coolant). A primary heat exchanger is adapted to transfer energy from the working fluid to the worked fluid (e.g., diluted completion fluids). The secondary section may comprise a flash tank in which the heated worked fluid is separated into vapor and liquid portions. The vapor portion is passed through a heat exchanger to condense the vapor back to liquid. The condensed liquid is removed from the system thereby concentrating the worked fluid.

It will be appreciated that the fluid transporting conduits used with embodiments of the present invention may comprise piping, tubing and other fluid communications structures of conventional and unconventional design and material. For most systems described herein it is preferred that the fluid conveyance material be carbon steel, when possible. Of course, the operating environment will likely dictate the material that is used. The circulation pumps may be of any conventional or unconventional design, but it is typically preferred that the pumps be hydraulic, pneumatic, electrical or direct drive (e.g., engine PTO) centrifugal pumps. Where positive displacement or metering pumps are needed or desired, it is preferred that pumps such as those offered by Moyno be used. Lastly, for the sake of clarity, detailed descriptions of instrumentation and control systems are not presented for the embodiments described herein. Instrumentation and control, whether manual, analog, digital, or processor based, is well within the ordinary of those in the art.

Turning now to more detailed and specific embodiments of my invention, FIG. 1 depicts one of many embodiments of a fluid heating subsystem. The heating subsystem 100 may comprise a rotary kinetic energy generator 102, a rotary heating device 104 and a primary heat exchanger 106 all in closed-loop fluid communication.

The rotary kinetic energy generator 102 may comprise any of a number of rotary prime movers, such as, but not limited to electric, pneumatic or hydraulic motors, and internal and external combustion engines. It is preferred that rotary generator 102 be a conventional diesel or natural gas engine, such as, for example, a 750 hp diesel engine.

The rotary heating device 104 may comprise any of a number of known devices, such as, but not limited to, a water brake (also known as a dynamometer), a cavitating rotary heater, such as those disclosed in U.S. Pat. No. 7,201,225, and those offered by Hydro Dynamics, Inc., and a shear plate or friction heaters. For the embodiments described herein, it is preferred that the rotary heating device 104 be a water brake dynamometer, such as Model TD3100 available from Taylor Dynamometer.

The output shaft or flywheel of the rotary generator 102 may be coupled to the rotary heater 104 in known fashion. For example, flex joints or other coupling mechanisms (not shown) may be used as needed to couple the rotary generator 102 to the rotary heater 104. One benefit of using a water brake dynamometer as the rotary heating device 104 is that it may be directly coupled to the flywheel or output shaft of an internal combustion engine.

The outlet side of the rotary heater 104 may be coupled to a reservoir or tank 110, if needed. Based on the operating characteristics of the rotary heater 104, the tank 110 may be pressurized, evacuated or un-pressurized. For the present embodiment using a water brake dynamometer as the rotary heater 104, it is preferred that tank 110 be un-pressurized and vented 112 to atmosphere. A fluid circulation pump 108, such as a centrifugal pump, is adapted to circulate or pump the fluid, i.e. the "working" fluid, through the system 100.

Working fluid may be circulated from the tank 110 to a fluid-to-fluid heat exchanger 114 adapted to transfer heat from the rotary generator 102 to the working fluid to further heat the fluid. For example, FIG. 1 illustrates that the engine coolant from, e.g., the engine's 102 water jacket, is used to further heat the working fluid. It will be appreciated that heat exchanger 114 may be in addition to or in lieu of the engine's 102 conventional air-to-fluid radiator. The working fluid that exits the heat exchanger 114 may pass through another heat exchanger 116, such as an air-to-fluid heat exchanger, to transfer energy from the engine's 102 exhaust gasses to the working fluid. As a matter of system design left to those of skill in the art, the engine's exhaust may pass entirely through the heat exchanger 116, or may be apportioned such that one portion passes through the heat exchanger 116 and the remainder passes through a conventional muffler or exhaust system (not shown).

It will be appreciated that while FIG. 1 illustrates the water jacket heat exchanger 114 down stream from the exhaust gasses heat exchanger 116, such orientation is not required and may be reversed or eliminated. It is preferred; however, that any supplemental heat exchangers, such as heat exchangers 114 and 116, be located between the discharge side of the rotary heater 104 and the primary heat exchanger 106. Heated working fluid is circulated from supplemental heat exchangers 114 and/or 116 to primary heat exchanger 106 and from there back to the rotary heating device 104 to complete the closed loop.

A controllable valve or other flow restriction device 118 is located on the inlet side of the rotary heating device 104. In the embodiment shown in FIG. 1, the valve 118 is controlled by the water brake 104 controller (not shown) as a function of engine 102 torque. Thus, valve 118 is controlled to load the rotary heater 104 such that the engine operates near it peak torque. Also shown in FIG. 1 is bypass circuit 119, which may be used to control the temperature of the fluid exiting the rotary heating device 104.

It will be appreciated that heating system 100 may be used to heat fluids of all types by flowing such fluid (the "worked" fluid) through primary heat exchanger 106 as illustrated in FIG. 1. System 100 may be instrumented as desired, and as illustrated in FIG. 1, several temperature transducers may be beneficial. For example, monitoring the temperature T4 of the working fluid prior to entry into tank 110 is useful especially where the tank is vented to atmosphere. Keeping the temperature of the working fluid below its boiling point will prevent loss of the working fluid to the atmosphere. It may be desired to monitor the temperature T1 of the working fluid as it exits the rotary heater 104 and prior to its entry T3 into the primary heat exchanger 106. It will be appreciated that working fluid temperature T4 can be controlled in several ways, including adjusting the flow rate of the worked fluid through heat exchanger 106, and/or adjusting the torque generated by the rotary generator 102, and/or adjusting the flow of working fluid into the rotary heating device.

Figure 2:
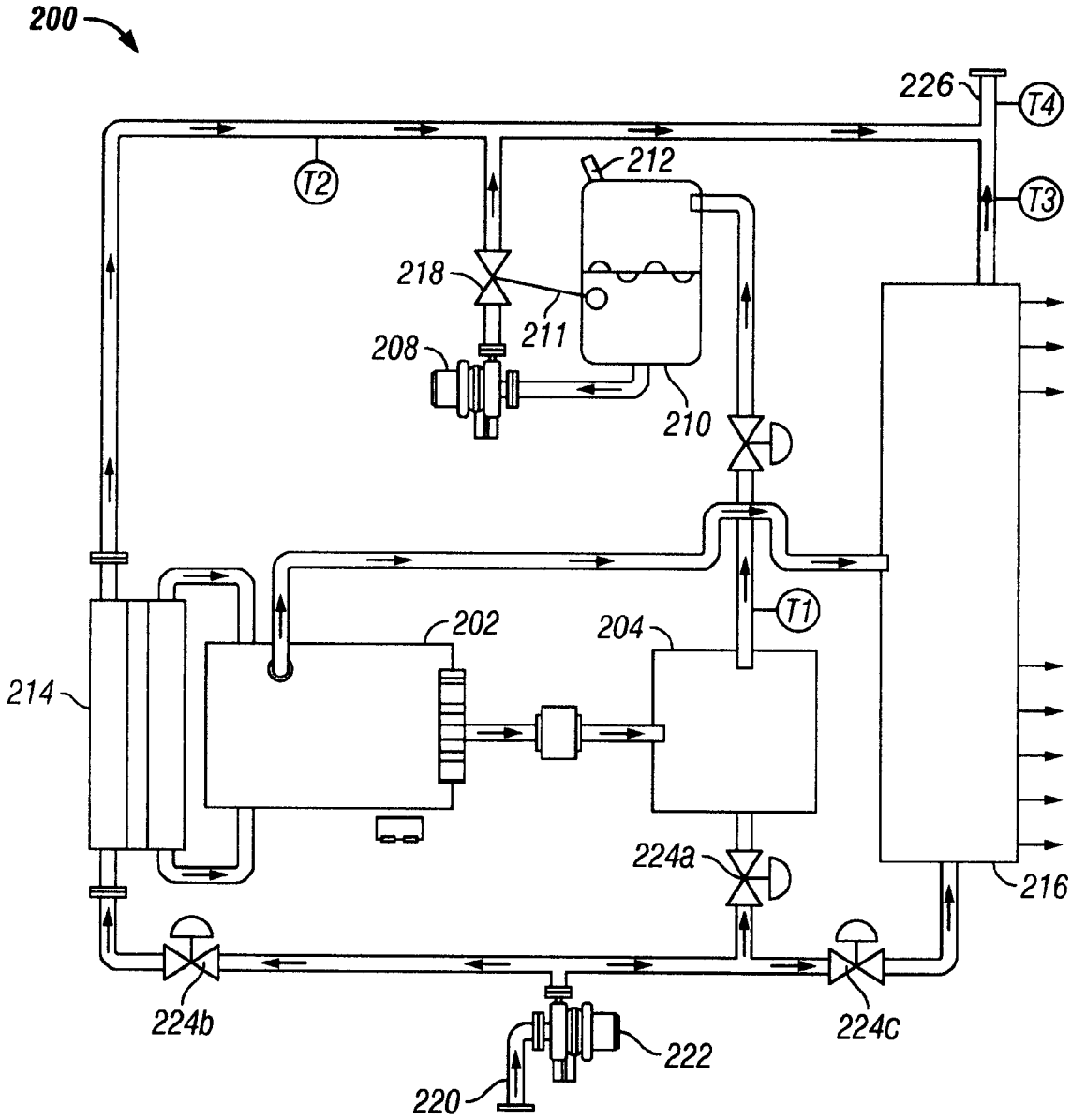
FIG. 2 illustrates one of many possible embodiments of a opened-loop fluid heater utilizing one or more aspects of the present invention.

FIG. 2 illustrates another embodiment of a flameless fluid heating system 200. In contrast to the system 100 illustrated in FIG. 1, the system 200 illustrated in FIG. 2 directly heats the fluid of interest. In other words, there is no closed-loop working fluid section and the fluid to be heated, such as, for example, fracturing fluid, is passed directly through the rotary heating device 204. In this embodiment, the rotary generator 202 is a diesel engine of, for example, 750 hp and the rotary heater is a Taylor Dynamometer model TD3100. Fluid enters the system 200 at inlet 220, preferably through an appropriately sized centrifugal pump 222, and is allowed to flow through three substantially parallel heating paths. Parallel flow paths is not required for all embodiments, but it will be appreciated that if the flow characteristics of heating devices, e.g., heat exchangers and rotary heating devices, are not similar, the lower flowing device will affect the maximum flow rate of the system. In the parallel system of FIG. 2, adjustment of fluid flow among these paths and, therefore, fluid temperature may be controlled by flow restrictions or valves 224*a*, 224*b* and 224*c*.

A first path is through valve 224*a* to the rotary heater 204 where torque from the engine 202 heats the fluid. The fluid leaves the rotary heater 204 and is collected in a tank 210 that is vented 212 to atmosphere. A main circulation pump 208 draws heated fluid from the tank 210 and returns it to system 200, generally. The tank 210 may have a fluid level control 211 adapted to control a flow valve 218 to regulate the level of fluid inside the tank.

A second fluid heating path has a portion of the fluid passing through restriction 224*b* and into a fluid-to-fluid heat exchanger 214 adapted to transfer heat from the diesel engine 202, such as the water jacket coolant, to the fluid. Fluid heated in exchanger 214 is combined with fluid from the rotary heater 204 as illustrated in FIG. 2. A third fluid heating path has a portion of the fluid passing through valve 224*c* and an air-to-fluid heat exchanger 216, such as a finned tube heat exchanger, adapted to transfer heat from the engine 202 exhaust to the fluid. Heated fluid exiting the heat exchanger 216 is combined with heated fluids from the rotary heater 204 and heat exchanger 214, with the combined heated fluid exiting the system 200 at outlet 226. The system illustrated in FIG. 2 was designed to raise the temperature of water by about 38° F. at a flow rate of about 280 gallons per minute.

It will be appreciated that FIGS. 1 and 2 illustrate two of many embodiments of flameless rotary heating systems according to the aspects of present invention. Those of skill in the art will be enabled by this disclosure to design closed- or open-loop heating systems for a wide variety of fluids and for a wide variety of purposes. For example, heating of corrosive or abrasive fluids may benefit from the closed-loop design of FIG. 1, although an open-loop system may be used with the rotary heater be fabricated from corrosion and/or abrasion resistant materials, if desired. Also, the temperature to which the fluid is heated may determine whether a closed- or open-loop system desired. For example, the potential for and effects of scaling in the heat exchangers and/or rotary heater should be considered in any heater system design.

Figure 3:
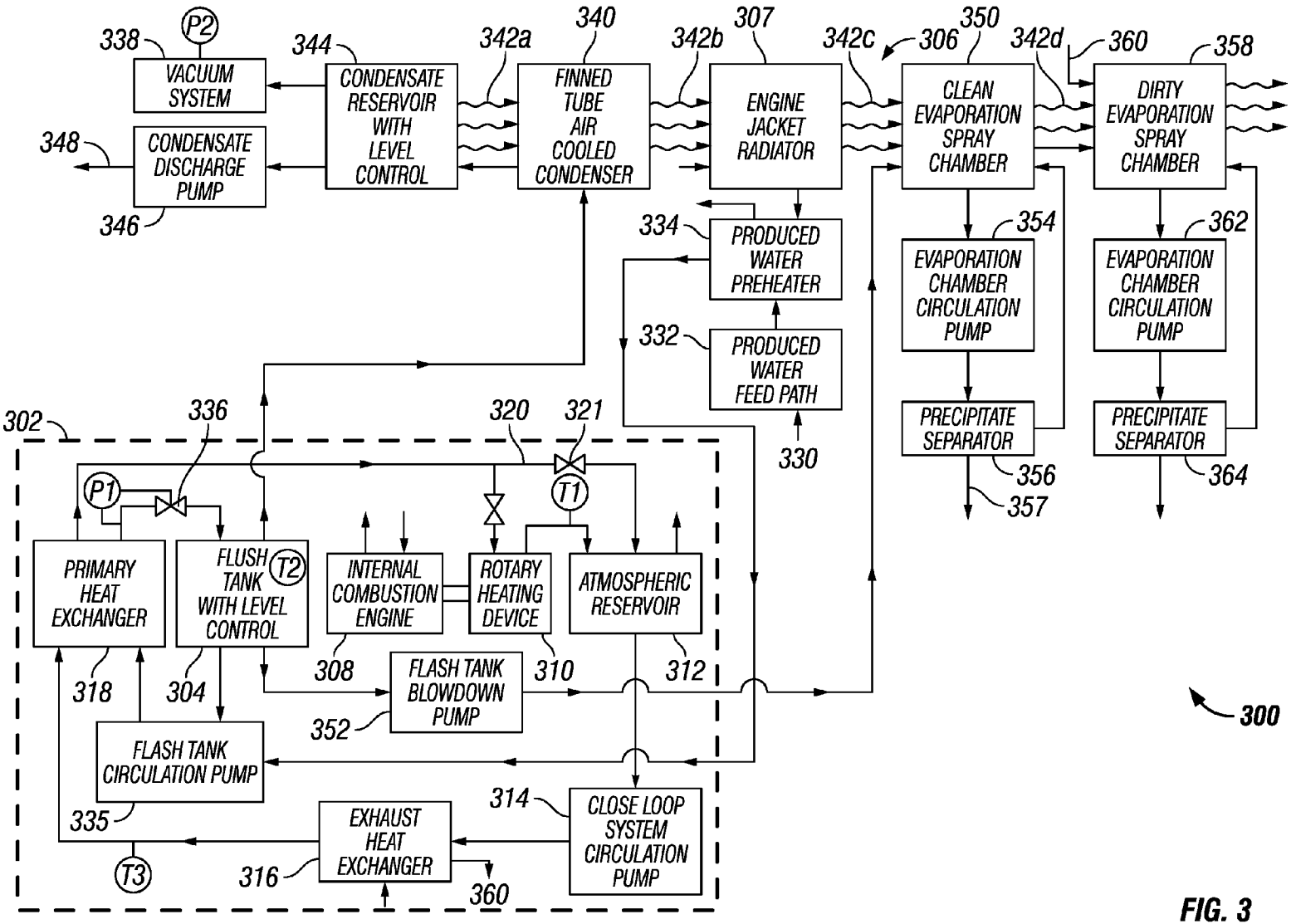
FIG. 3 illustrates one of many embodiments of a system utilizing one or more aspects of the present invention for evaporating a fluid.

A fluid heating system, such as systems 100 or 200, may form a subsystem of other systems, such as fluid concentrating systems or fluid evaporating systems. To this point, illustrated in FIG. 3 is a preferred evaporating system 300 particularly suited for evaporating water produced from subterranean wells or mines. Shown generally by dashed line is a heating subsystem 302 (as described below, flash tank 304 is rightly considered a part of the evaporation subsystem 306 and not the heating subsystem 302, and engine jacket heat exchanger 307 is rightly a part of the heating subsystem 302). As described with respect to FIG. 1, a closed-loop heating subsystem 302 comprises a rotary generator 308, preferably a natural gas or diesel engine, coupled to a rotary heating device 310, preferably a water brake dynamometer. The rotary heater 310 is plumbed in closed-loop fashion to a tank 312 that is vented to the atmosphere, a circulation pump 314, such as a centrifugal pump, an engine 308 exhaust gas heat exchanger 316, engine jacket heat exchanger 307 and a primary heat exchanger 318. Also, shown in FIG. 3 is rotary heater bypass 320 and bypass valve 321. In a preferred embodiment, the temperature T3 of the working fluid as it enters the primary heat exchanger 318 is used to control the position of the bypass valve 321 to maintain the temperature of the working fluid at a desired point, such as at a temperature below its atmospheric boiling point.

Also illustrated in FIG. 3 is an evaporation subsystem 306 comprising a inlet 330 for the worked fluid (i.e., the fluid that is subject to evaporation), a positive displacement feed pump 332, preferably a Moyno metering pump, and a fluid-to-fluid heat exchanger 334 adapted to preheat the worked fluid with heat from the engine jacket coolant. Preheated worked fluid is pumped 335 to the primary heat exchanger 318 where it picks up additional energy from the heating subsystem 302. The heated worked fluid is pumped to the flash tank 304 through orifice or valve 336, which is selected to maintain sufficient pressure in the system 306 to prevent the fluid from flashing (i.e., vaporizing) until it enters the flash tank 304. It is preferred that the flash tank operate at negative atmospheric pressure, typically around about 0.9 to 2.5 psia (i.e., a vacuum of about 28 to 25 inches of mercury). A vacuum system 338, such as a liquid ring pump, is used to maintain the vacuum in the flash tank. It will be appreciated that as heated fluid enters the flash tank 304 a portion flashes off into vapor (e.g. steam), which is drawn by vacuum system 338 to an air-to-fluid heat exchanger 340, preferably a finned tube heat exchanger. Ambient air 342*a* is forced through heat exchanger 340 to transfer heat from the fluid vapor to the air 342*a*. As will be described below, the heated air 342*b* will be used to evaporate fluid that collects in the flash tank 304.

The transfer of heat in heat exchanger 340 causes the fluid vapor to condense, which condensate is collected in a condensate receiver 344. It is preferred that the condensate receiver 344 be equipped with a fluid level control adapted to control a condensate pump 346. The level control and pump 346 are configured to maintain a relatively fixed fluid level in condensate receiver 344. It will be appreciated that condensed fluid 348, for example water, will be relatively clean and may be used for various purposes as needed or disposed of as allowed.

Returning to the heat exchanger 340, heated air 342*b* exits the heat exchanger 340 and at least a portion is forced through the engine jacket heat exchanger or radiator 307, where the portion of the air 342*b* picks up additional heat. This heated air 342*c* along with any remainder of the air 342*b* is forced through one or more evaporation chambers 350. Evaporation chamber 350 may be considered a "clean" chamber insofar as the heated air 342*c* is relatively clean, typically having only natural contaminants, such as dirt, dust, pollen and the like.

A fluid pump 352, such as a centrifugal pump, is coupled to the flash tank 304 so that collected fluid, i.e. liquid, is pumped to evaporation chamber 350. It is preferred that one or more spray nozzles or other types of misting or spraying devices be used to spray or mist flash tank 304 fluid inside chamber 350. In a preferred embodiment, one or more spray nozzles are located adjacent an upper surface of the chamber 350. Also in the preferred embodiment of FIG. 3, heated air 342*c* is forced to flow substantially normal or perpendicular to the sprayed fluid to thereby evaporate at least a portion of the liquid. It will be appreciated that suitable baffles or other contact surfaces may be installed in chamber 350 to minimize or eliminate condensing fluid from exiting chamber 350 with heated moist air 342*d*.

Unevaporated fluid collects in the chamber 350 and a circulation pump 354 may be used to recirculate this fluid through the chamber for additional evaporation. Additionally, if desired, the collected fluid can be passed through a filtration or separation system 356 to remove particulates 357 from the fluid. It is preferred that separation system 356 comprises a hydroclone. Excess fluid from system 356 can be returned to the chamber 350 for evaporation. Recovered particulates 357 can be disposed of as allowed, or if a market exists for such recovered particulates, sold.

If only one evaporation chamber 350 is utilized, it is preferred that chamber 350 comprise a fluid level control device adapted to control fluid pump 352, preferably a positive displacement pump, such as those offered by Moyno, to maintain the fluid flow and evaporation through chamber 350 at a desired level.

Optionally, an additional evaporation chamber 358 may be utilized as desired. This evaporation chamber 358 may be described as a "dirty" chamber in that exhaust gasses from rotary generator 308 (e.g, natural gas or diesel engine) may be used to further evaporate fluid. As illustrated in FIG. 3, exhaust gasses 360 from the heat exchanger 316 are introduced, along with warm, moist air 342*d*, if desired, into chamber 358. Chamber 358 may be designed similarly to chamber or chambers 350. Fluid to be evaporated may be drawn from chamber 350 and sprayed or otherwise contacted with air 342*d* and gasses 360 to evaporate at least a portion of the fluid. Chamber 358 may likewise comprise a circulation pump 362 and filter/separation system 364, as desired. It will be appreciated that an additional benefit of "dirty" chamber 358 is that it can be used to scrub or clean the exhaust gasses 360 prior to discharge into the environment.

It will be appreciated that system 300 can be designed and operated to evaporate all of the fluid input into the subsystem 306 or only a portion of the fluid inputted. For those systems where less than complete evaporation is desired or required, evaporation chamber blowdown may be extracted and disposed of as allowed and required. For systems utilizing scrubbing of the exhaust gasses, disposal of at least a portion of the blowdown will likely be required.

Figure 4:
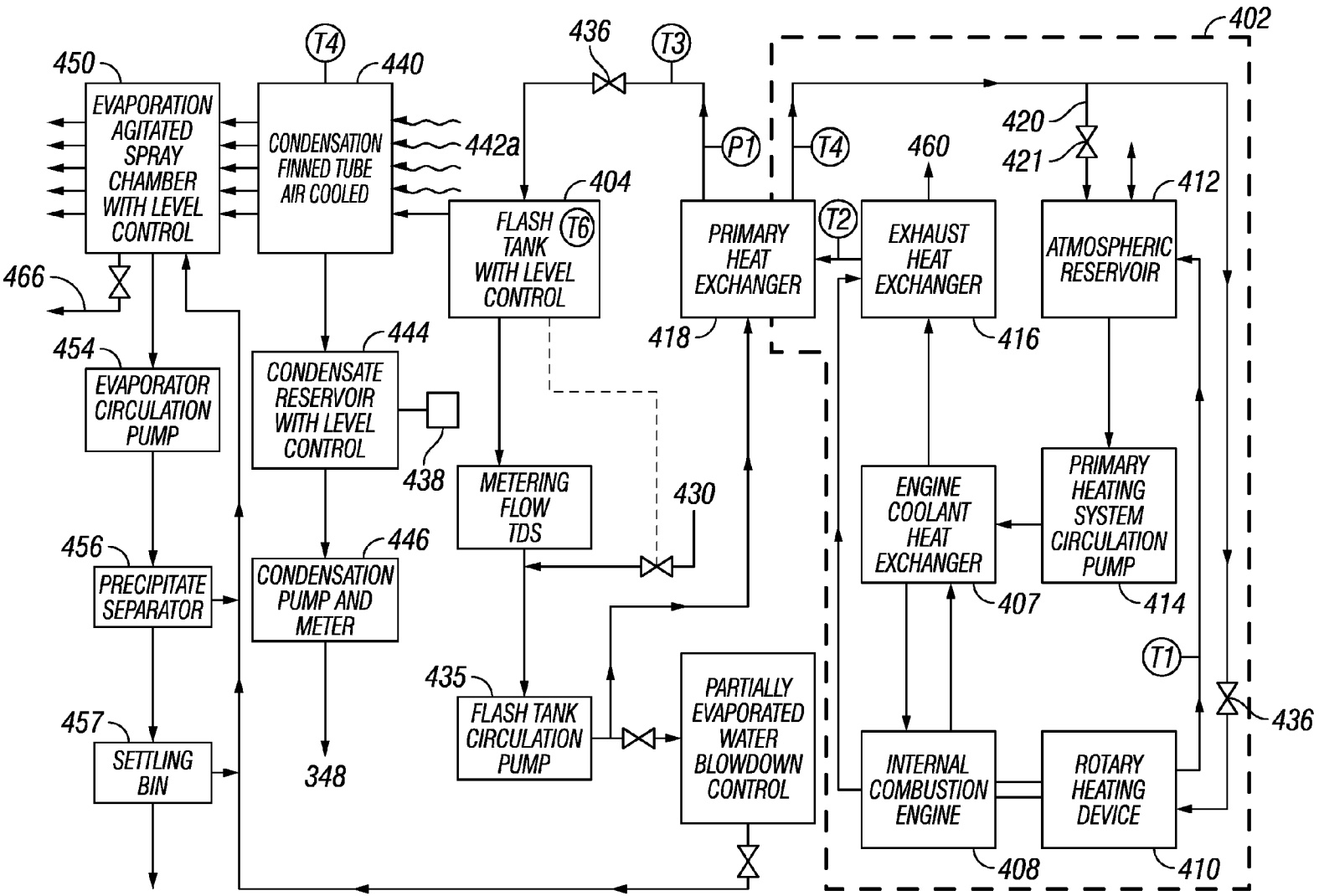
FIG. 4 illustrates another embodiment of a system utilizing one or more aspects of the present invention for evaporating a fluid.
Figure 5:
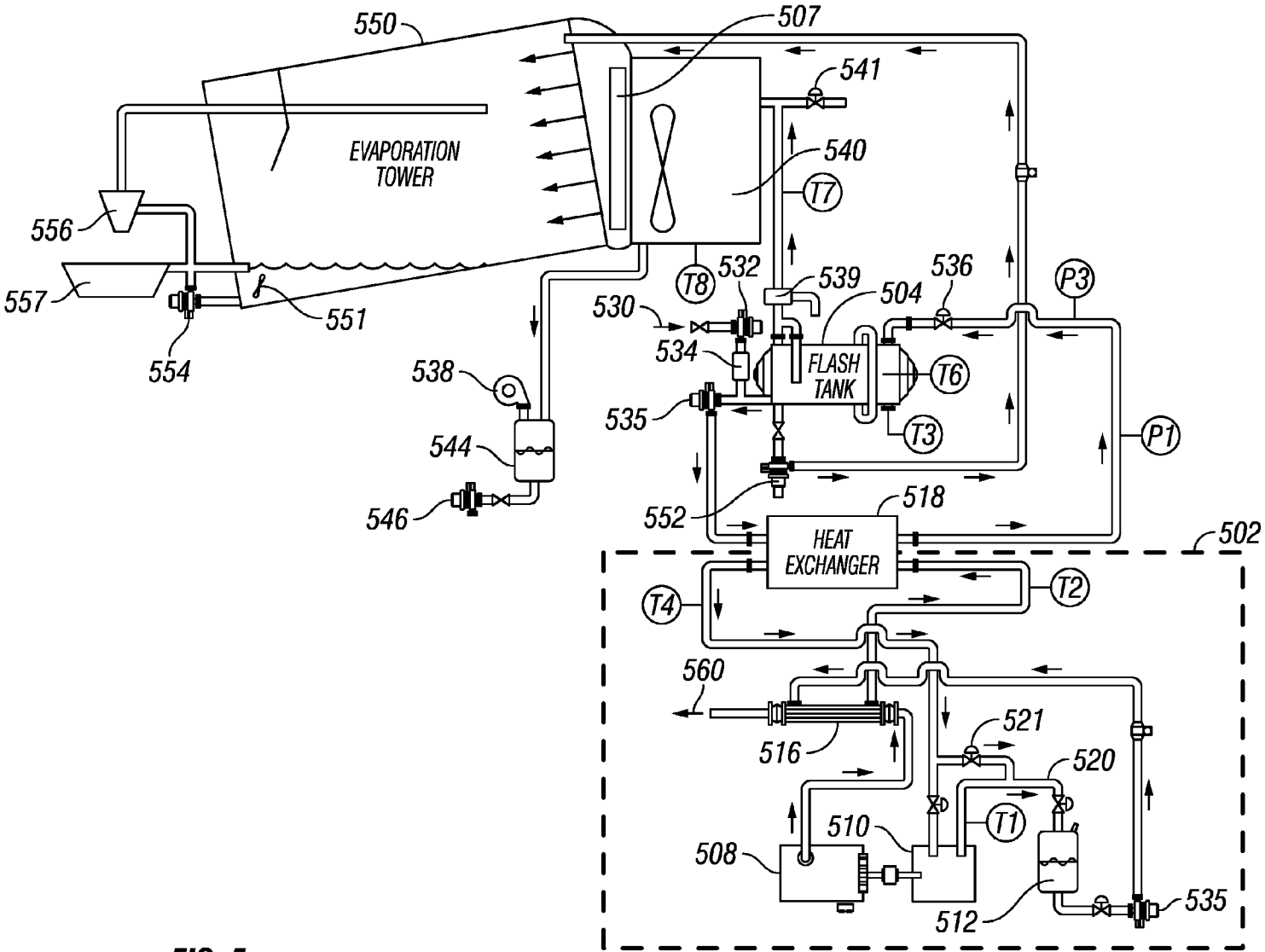
FIG. 5 illustrates another embodiment of a system utilizing one or more aspects of the present invention for evaporating a fluid.

FIGS. 4 and 5 illustrate alternate embodiments of an evaporating system. The detailed description set forth above with respect to the embodiment of FIG. 3 applies to FIGS. 4 and 5 with common structures having similar reference numbers. For example, in all of FIGS. 3, 4 and 5, the flash tank is identified by reference number 304, 404 and 504, respectively.

Concerning FIG. 4, incoming fluid 430 is mixed with fluid from the flash tank 404 and then split with a portion flowing directly to primary heat exchanger 418 and back to the flash tank 404, and the other portion diverted to the evaporation chamber 450 for evaporation. In one embodiment, as the amount of particulate matter, e.g. total dissolved solids, in the flash tank increase, more fluid is diverted to the evaporation chamber 450, which allows more new fluid 430 to enter the system.

Additionally FIG. 5 discloses the flash tank having a demister hood 539 to ensure that the vapor conducted to the heat exchanger 540 is relatively dry. Also, chamber 550 is disclosed as having an agitator system 551 to keep any particulate matter suspended in the liquid fluid for removal by systems 556 and 557. FIG. 5 also shows a desuperheating inlet 541 allowing the introduction of fluid, if needed, such as condensate, to desuperheat the steam entering the condenser 540.

An evaporator system according to the present invention was designed for produced water having total dissolved solids of about 9,000 parts per million. A 600 horsepower natural gas engine with a fuel consumption of 4,300 cubic feet per hour was selected as the prime mover. The system was designed to accept up to 7,135 pounds of produced water per hour (approximately 14.3 gallons per minute). The system was designed to evaporate approximately 100% of the produced water input or 7,135 pounds/hour, and to create approximately 2,651 pounds/hour condensate for use or disposal. The system was calculated to produce about 1,500 pounds/day of solids for disposal. The finned tube condenser was designed to have aluminum fins on carbon steel tubes having about 6,800 square feet of surface area and adapted to exchange about 3,337,565 BTU/hour. The heating section was designed to operate at between about 150 and 180° F. at about atmospheric pressure. The flash tank was designed to operate at about 130 to 170° F. at about 25 inches of mercury (vacuum). The condenser was designed to output air heated to about 130° F. at a velocity of about 60,000 cfm.

As will now be appreciated, FIGS. 3, 4 and 5 illustrate merely three of many embodiments of a fluid evaporation system comprised of a flameless heating subsystem and an evaporation subsystem. Depending upon the characteristics of the fluid to be evaporated (i.e., the worked fluid), the environment in which the system will be used and economic considerations, the evaporation system may be designed and operated to evaporate substantially all of the worked (e.g., produced water) or only a portion of the worked fluid, with the remainder being disposed of, if necessary, by allowable and economic means.

It will also be appreciated that the fluid evaporating systems can be used to remove (by evaporation) fluid from the worked fluid to effectively concentrate the worked fluid. The concentrated fluid can be extracted from one or more of the evaporation chambers. It will also be appreciated that it may not be desirable to concentrate certain worked fluids (e.g., a diluted well completion fluid) by forcing heated ambient air through the fluid. Particles entrained in the air, such as dirt, dust, pollen, or exhaust gasses may contaminate the worked fluid.

Figure 6:
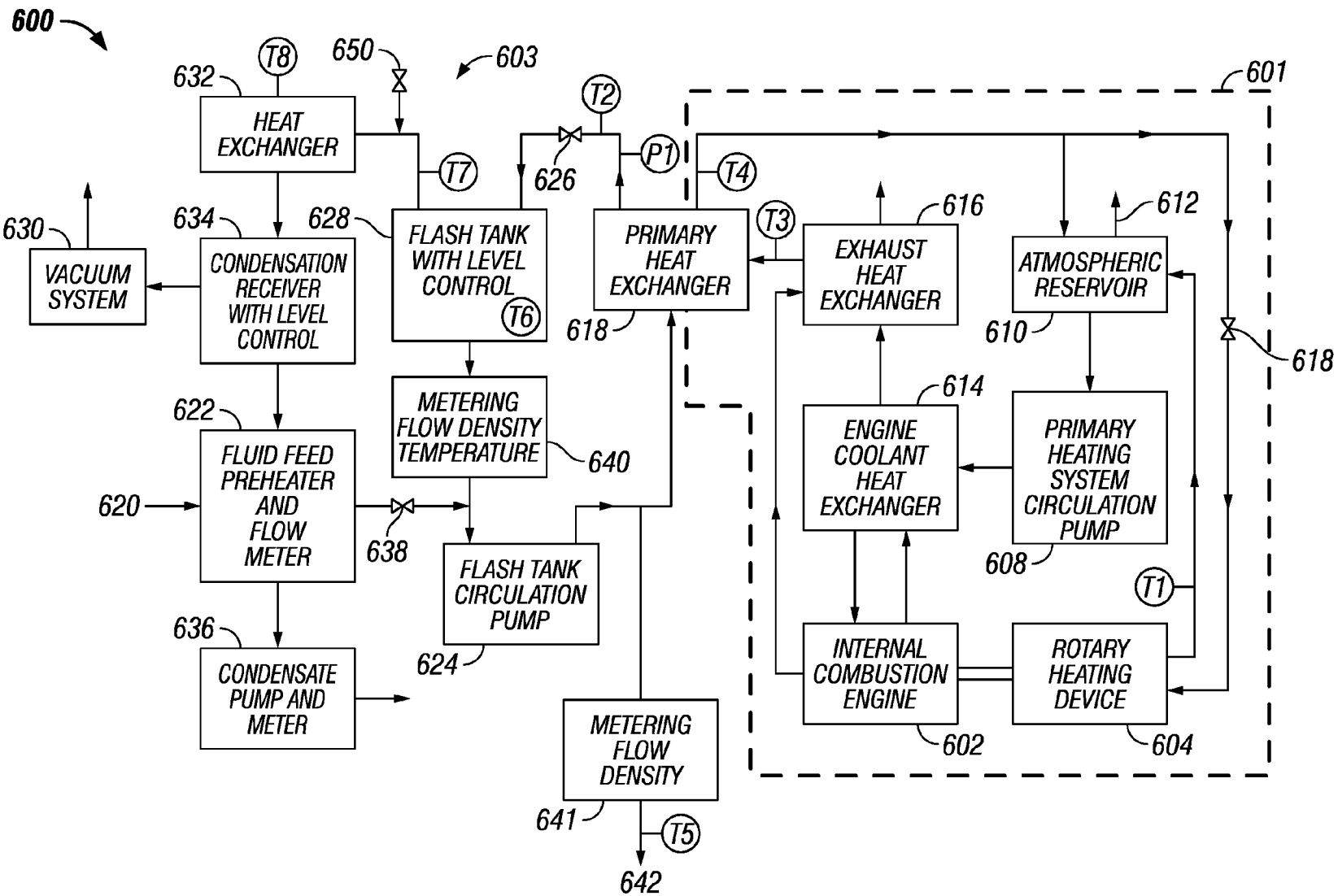
FIG. 6 illustrates one of many embodiments of a system utilizing one or more aspects of the present invention for concentrating a fluid.
Figure 7:
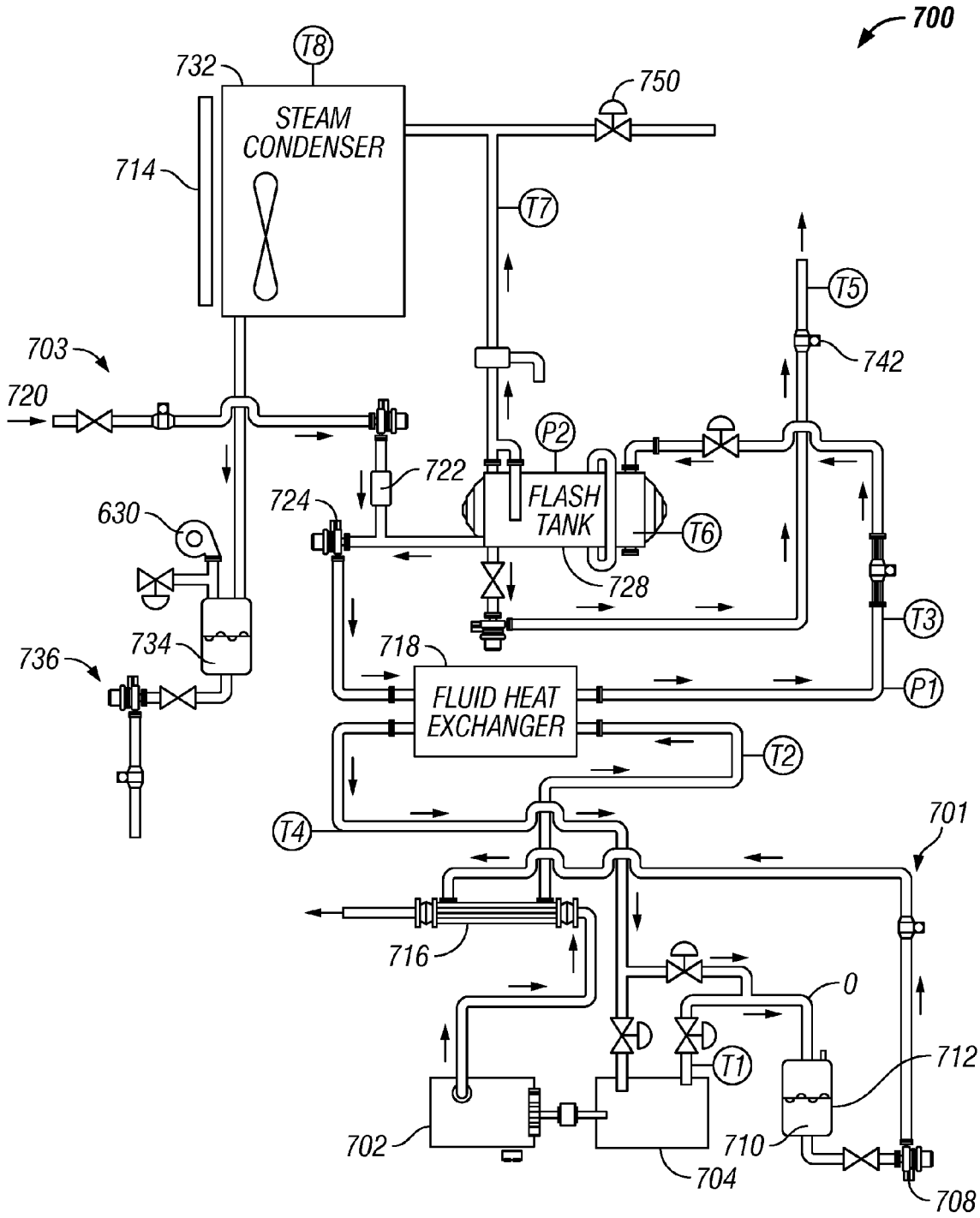
FIG. 7 illustrates another embodiment of a system utilizing one or more aspects of the present invention for concentrating a fluid.

Therefore, FIGS. 6 and 7 illustrate concentrator systems 600 and 700 in accordance with the present invention. For purpose of this description, like elements have like reference numerals. Thus, for example, the condensate reservoir is referenced as structures 634 and 734 in FIGS. 6 and 7, respectively. While only reference numbers found in FIG. 6 may be stated, this description will be understood to apply equally to similarly referenced elements in FIG. 7. The concentrator system 600, 700 comprises a flameless heater subsystem, such as those described above with respect to FIGS. 1 and 2. The particular heater subsystem illustrated in FIGS. 6 and 7 is a closed-loop subsystem similar to that illustrated in FIG. 1. The reference numbers and descriptions used for FIG. 1 are applicable to FIGS. 6 and 7 as well. For example, rotary heating device 104 in FIG. 1 is rotary heating device 604 in FIGS. 6 and 704 in FIG. 7.

The concentrating system 600, 700 also comprises a concentrating subsystem 603, 703. In subsystem 603 and 703, fluid to be concentrated 620 is preheated in heat exchanger 622, which is adapted to transfer heat from the condensed fluid, as will be described below. Fluid 620 is pumped 624 through primary heat exchanger 616 where the fluid 620 is heated by heating subsystem 601. Heated fluid 620 is passed through an orifice or valve 626 adapted to create a pressure differential across the device 626 of about 30 psid. The fluid 620 is flashes in tank 628 where it separates into its vapor and liquid phases. The flash tank 628 is preferably operated under negative atmospheric pressure of about 0.9 to 2.5 psia (i.e., a vacuum of about 28 to 25 inches of mercury). A vacuum system 630, such as a liquid ring pump, may be used to maintain the system vacuum.

The vapor phase of fluid 620, such as steam, is passed through a heat exchanger 632, which may be a fluid-to-fluid or air-to-fluid heat exchanger. Heat exchanger 632 functions as a condenser to condense the fluid vapor back to its liquid phase. The condensed fluid is collected in a reservoir 634 and, as mentioned above, passed through preheater 622 to preheat the incoming fluid 620. It is preferred that reservoir 634 be equipped with a level control system that controls a condensate pump 636. It will be appreciated that the condensate that is produced by system 600 is relatively clean and may used for a variety of purposes or discarded as allowed.

Referring back to flash tank 628, concentrated liquid fluid accumulates in the tank 628 and may withdrawn by circulation pump 624. A metering and detecting system 640 may be used to assess, determine or calculate one or more properties of the concentrated fluid. For example, system 640 can be adapted to determine the temperature, density, specific gravity, conductivity or other property of the concentrated fluid. Preheated incoming fluid 620 may be mixed with the concentrated fluid to reduce the temperature of the concentrated fluid as necessary. An extraction system 641 may be adapted to determine the temperature, density, specific gravity, conductivity or other property of the concentrated fluid, and to extract the desired concentrated fluid from the system 600.

The system 640 may be adapted to control a valve or other flow restricting device 642 so that when one or more desired properties, such as, for example, specific gravity, of the concentrated fluid is reached, the concentrated fluid can be extracted from system 600. A metering device may be used to determine the amount of concentrated fluid removed from the system.

The amount of incoming fluid 620 allowed into the subsystem 603 is controlled by a valve or other flow-restricting device 638, which may be controlled by a fluid level device in flash tank 628. In other words, additional fluid is allowed into subsystem 603 to maintain a desired level of fluid in flash tank 628. As fluid is extracted from the subsystem 603 through valve 642, the liquid level in tank 628 decreases thereby allowing more fluid 620 into the system. To the extent it is desired to cool extracted concentrated fluid, such fluid may be used, for example, to preheat incoming fluid 620.

Also illustrated in FIGS. 6 and 7 is an optional desuperheat inlet into heat exchanger 632, 732. In the event the steam entering the heat exchanger is superheated, fluid, such as liquid water, can be introduced through valve 650, 750 to desuperheat the steam. Condensate removed from the system can be used for this purpose.

As with other systems described herein, it is preferred, but not required that the worked fluid be limited to temperatures below its atmospheric boiling point. Thus, it is preferred that the systems be operated under vacuum. However, this is not required and is left to the design considerations of the particular system being implemented.

Figure 8:
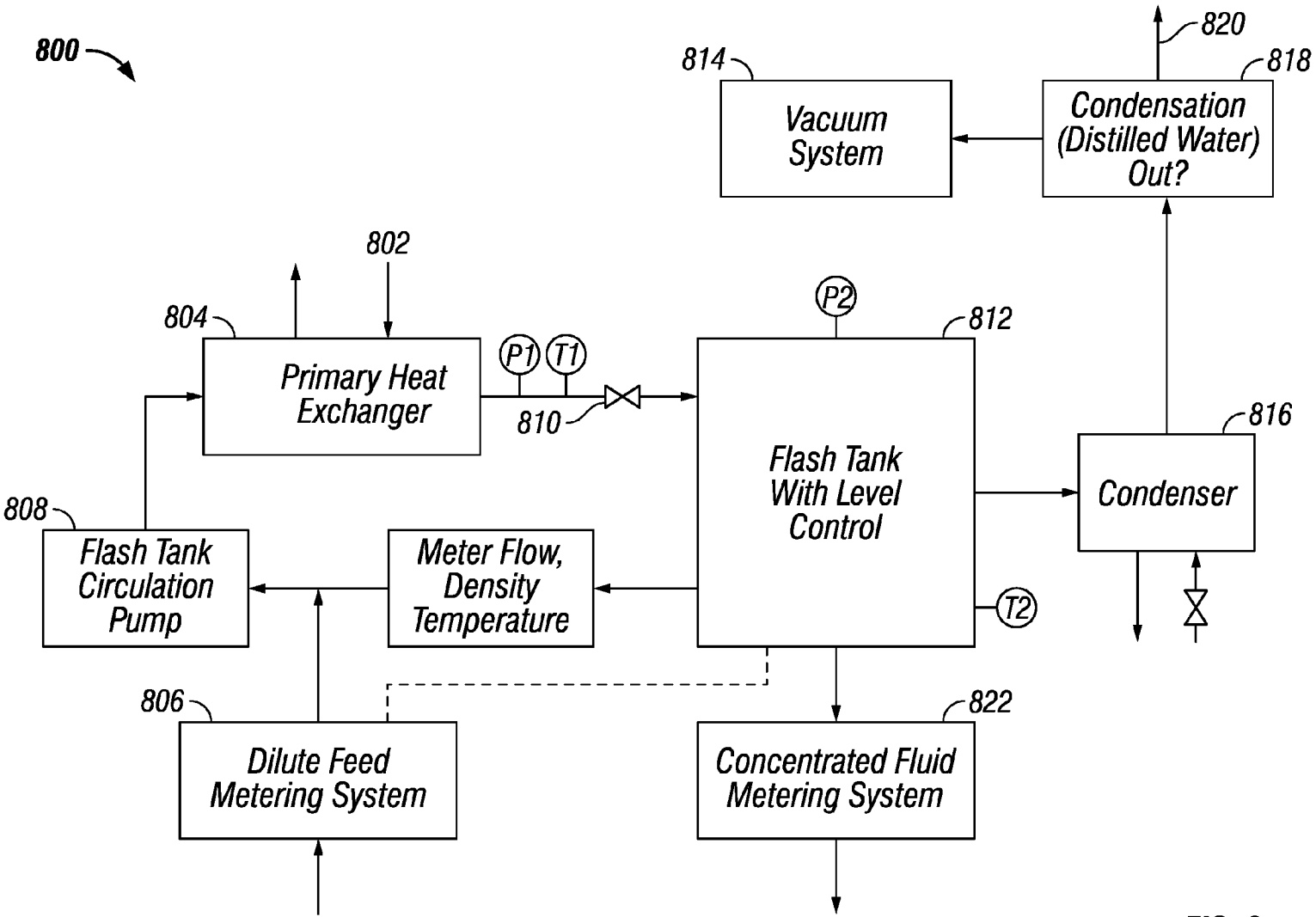
FIG. 8 illustrates another embodiment of a system utilizing one or more aspects of the present invention for concentrating a fluid.
Figure 9:
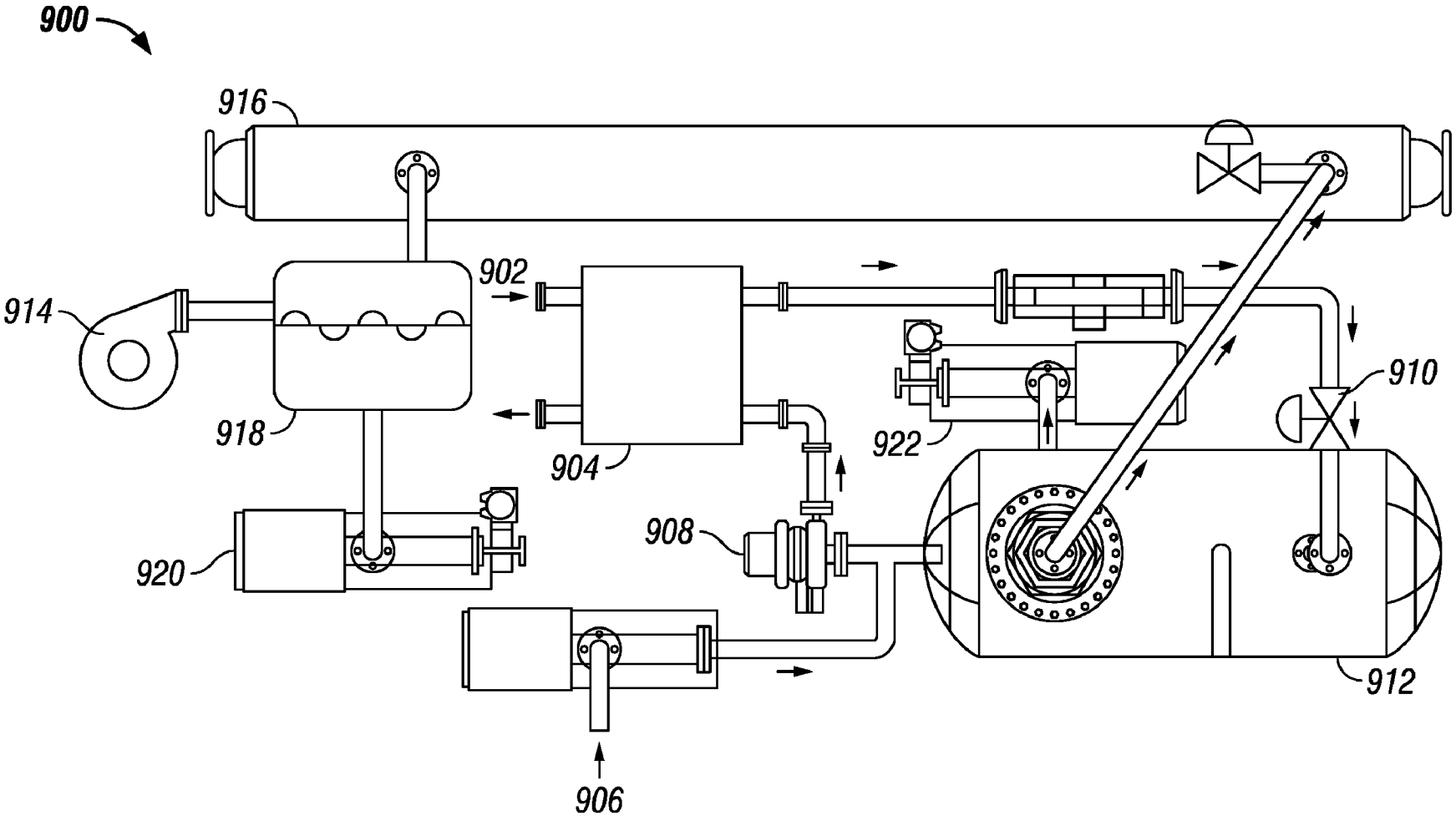
FIG. 9 illustrates another embodiment of a system utilizing one or more aspects of the present invention for concentrating a fluid.

Turning now to FIGS. 8 and 9, alternative concentrator systems 800 and 900 are presented. These embodiments are particularly suited for use on offshore drilling or production platforms. It will be immediately noted that neither system 800 or 900 comprises a heating subsystem as described above. Instead, the concentrator system is integrated into an existing thermal energy source from the rig or platform. For example, and preferably, coolant from one or more internal combustion engines is introduced into a primary heat exchanger 804, 904 to transfer heat to a diluted fluid 806, 906 that is in need of being concentrated. Additionally or alternately, exhaust gasses from one or more internal combustion engines may be used to heat diluted fluid 806, 906.

As has been described above with respect to FIGS. 6 and 7, diluted fluid 806, 906 is introduced into the system 800, 900. A metering system 808, 908 may be used to determine the amount of diluted fluid introduced. A circulation pump 810, 910 is used to circulate the diluted fluid through the primary heat exchanger 802, 902 to pick up heat. The heated, dilute fluid 806, 906 flows through a valve or other flow restriction device 810, 910 adapted to create a pressure differential across the device 810, 910 of about 30 psid. The fluid 806 is flashed in tank 812, 912 where it is separated into its vapor and liquid phases. The flash tank 812, 912 is preferably operated under negative atmospheric pressure of about 0.9 to 2.5 psia (i.e., a vacuum of about 25 to 28 inches of mercury). A vacuum system 814, 914, such as a liquid ring pump, may be used to maintain the system vacuum.

The vapor phase of fluid 806, 906, such as steam, is passed through a heat exchanger 816, 916, which may be a fluid-to-fluid or air-to-fluid heat exchanger, but preferably a fluid-to-fluid heat exchanger using seawater as coolant. Heat exchanger 816, 916 functions as a condenser to condense the fluid vapor back to its liquid phase. The condensed fluid is collected in a reservoir 818, 918. Alternately, the condensate can be used to preheat the incoming fluid 806, 906. It is preferred that reservoir 818, 918 be equipped with a level control system that controls a condensate pump 820, 920. It will be appreciated that the condensate that is produced by system 800, 900 is relatively clean and may used for a variety of purposes or discarded as allowed. Referring back to flash tank 812, 912, concentrated liquid fluid accumulates in the tank and may withdrawn by a fluid extraction and metering system 822, 922 as described above.

Thus, my inventions have been described in the context of preferred and other embodiments and not every embodiment of the invention has been described. Obvious modifications and alterations to the described embodiments are available to those of ordinary skill in the art.

For example, it will be appreciated that because of the related functionality of the systems I have disclosed, a single system may be designed that is adapted to heat, concentrate and/or evaporate fluid. Also, because of the inherent modularity of these systems, the disclosed subsystems may be fabricated on separate skids or in separate packages, such as containers, to aid transport and coupled together on site. Economic factors well known to those of skill art will likely dictate whether a diesel, natural gas or other form of prime mover is utilized.

The disclosed and undisclosed embodiments are not intended to limit or restrict the scope or applicability of the invention conceived of, but rather, in conformity with the patent laws, I intend to protect all such modifications and improvements to the full extent that such falls within the scope or range of equivalent of the following claims. If a word or phrase used in a claim does not appear in this application and such word or phrase has no specialized meaning in the relevant art, then any such word should be construed according to its ordinary and customary meaning and any such phrase should be construed according to the ordinary and customary meaning of each word in the phrase.

What is claimed is:

1. A method of evaporating a fluid, comprising:

providing a prime mover adapted to generate rotational kinetic energy and thermal energy;

coupling a dynamometer to the prime mover so that rotational kinetic energy is transferred to the dynamometer;

circulating a first fluid through the dynamometer to impart thermal energy to the fluid;

circulating the first fluid through at least one heat exchanger adapted to transfer thermal energy of the prime mover to the fluid;

circulating the fluid through at least a second heat exchanger;

passing a second fluid through the at least second heat exchanger to transfer thermal energy from the first fluid to the second fluid thereby heating the second fluid;

flashing the second fluid into its vapor and liquid phases;

providing a holding tank adapted to contain the liquid and vapor phases of the second fluid;

providing a fluid-to-air condenser in fluid communication with the tank for condensing a portion of the second fluid vapor by passing air across the condenser to transfer thermal energy from the vapor to the air; and providing an evaporation chamber in fluid communication with the tank for evaporating a portion of the second fluid liquid with the heated air.

2. The method of claim 1, wherein the dynamometer is a water brake dynamometer.

3. The method of claim 1, wherein the first fluid is a water-based mixture.

4. The method of claim 1, wherein the prime mover is an internal combustion engine.

5. The method of claim 4, wherein the internal combustion engine is a natural gas engine.

6. The method of claim 4, further comprising heating the air with thermal energy from a cooling system of the internal combustion engine.

7. The method of claim 1, further comprising removing unevaporated fluid from the evaporation chamber.

8. The method of claim 1, further comprising disposing of the unevaporated fluid.

9. The method of claim 1, further comprising evaporating at least 80% of the fluid introduced into the evaporation chamber.

10. A method of concentrating a fluid, comprising:

providing a prime mover adapted to generate rotational kinetic energy and thermal energy;

coupling a dynamometer to the prime mover so that rotational kinetic energy is transferred to the dynamometer;

circulating a first fluid through the dynamometer to impart thermal energy to the fluid;

circulating the first fluid through at least one heat exchanger adapted to transfer thermal energy of the prime mover to the fluid;

circulating the fluid through at least a second heat exchanger;

passing a second fluid through the at least second heat exchanger to transfer thermal energy from the first fluid to the second fluid thereby heating the second fluid;

flashing the second fluid into its vapor and liquid phases;

providing a holding tank adapted to contain the liquid and vapor phases of the second fluid;

providing a condenser in fluid communication with the tank for condensing a portion of the second fluid vapor;

condensing the second fluid vapor to its liquid phase; and extracting at least a portion of the condensed vapor to thereby concentrated the second fluid.

11. The method of claim 10, wherein the dynamometer is a water brake dynamometer.

12. The method of claim 10, wherein the first fluid is a water-based mixture.

13. The method of claim 10, wherein the prime mover is an internal combustion engine.

14. The method of claim 13, wherein the internal combustion engine is a diesel engine.

15. The method of claim 13, further comprising using thermal energy from exhaust gasses of the internal combustion engine to heat the first fluid.

* * * * *